US007900675B2

(12) United States Patent
Dangami et al.

(10) Patent No.: US 7,900,675 B2
(45) Date of Patent: Mar. 8, 2011

(54) LABEL PRINTER

(75) Inventors: Akira Dangami, Tokyo (JP); Kenji Kobayashi, Tokyo (JP)

(73) Assignee: Lintec Corporation, Tokyo (JP)

( * ) Notice: Subject to any disclaimer, the term of this patent is extended or adjusted under 35 U.S.C. 154(b) by 805 days.

(21) Appl. No.: 11/721,634

(22) PCT Filed: Jan. 17, 2006

(86) PCT No.: PCT/JP2006/300466

§ 371 (c)(1),
(2), (4) Date: Jun. 13, 2007

(87) PCT Pub. No.: WO2006/080203

PCT Pub. Date: Aug. 3, 2006

(65) Prior Publication Data

US 2009/0272495 A1 Nov. 5, 2009

(30) Foreign Application Priority Data

Jan. 26, 2005 (JP) ..... 2005-017671

(51) Int. Cl.
*B65C 9/26* (2006.01)

(52) U.S. Cl. ..... 156/387; 156/384; 156/247; 156/277; 156/285; 156/537; 156/539; 156/541; 156/542; 156/556; 156/358; 156/156

(58) Field of Classification Search ..... 156/387
See application file for complete search history.

(56) References Cited

U.S. PATENT DOCUMENTS 4,255,220 A 3/1981 Kucheck et al.

FOREIGN PATENT DOCUMENTS

| | | | |
|---|---|---|---|
| JP | 63-115168 | | 7/1988 |
| JP | 05-229541 | | 9/1993 |
| JP | 05229541 | A * | 9/1993 |
| JP | 08-036361 | | 2/1996 |
| JP | 11-048639 | | 2/1999 |
| JP | 2001-246882 | | 9/2001 |
| JP | 2003-002312 | | 1/2003 |
| JP | 2003-261118 | | 9/2003 |
| JP | 2006181991 | A * | 7/2006 |
| WO | WO 2006070569 | A1 * | 7/2006 |

* cited by examiner

*Primary Examiner* — Philip C Tucker
*Assistant Examiner* — Vicki Wu
(74) *Attorney, Agent, or Firm* — Lowe Hauptman Ham & Berner LLP

(57) ABSTRACT

There is provided a printing device 12 that performs printing on each of first and second labels L1, L2 on the way of feeding out a raw strip sheet M, which is temporarily stuck with a first label L1 and a second label L2 having a smaller plane area than that of the first label on a release liner S, a peel plate 27 that peels off the first and second labels L1, L2 from the release liner S, first and second label suction plates 30, 31 that hold the respective peeled labels L1, L2, and a laminating device 17 that laminates the first and second labels L1, L2 with the adhesive layer of the second label L2 facing the adhesive layer of the first label L1. The adhesive layer of the first label L1 laminated with the second label L2 is exposed in a closed loop manner in an outer peripheral area all around the second label L2.

5 Claims, 7 Drawing Sheets

LABEL PRINTER

RELATED APPLICATIONS

The present application is based on, and claims priority from, International Application No. PCT/JP06/300466, filed Jan. 17, 2006, and Japan Application Number 2005-017671, filed Jan. 26, 2005, the disclosures of which are hereby incorporated by reference herein in their entirety.

TECHNICAL FIELD

The present invention relates to a label printer, in particular to a label printer suitable for sticking a first label and a second label to an object so as to be stuck in a state that the second label is positioned at an adhesive layer side of the first label and sandwiched between the object and the first label.

BACKGROUND ART

Recently, accompanying a global-wide expansion of the Internet, TV shopping and the like, in addition to a conventional over-the-counter sale, mail-order sale has come into wide use. In the mail-order sale, a deliverer delivers an article in place of a seller, and as common payment methods for the cost arisen from that, payment by bank transfer, credit card, postal transfer, and payment through a convenience store are widely employed. On the other hand, a method of payment-on-delivery is often employed by many consumers, who don't like the idea of going to a monetary institution or the like, or consumers, who are afraid of leaking their private information.

In the case of the payment-on-delivery, since the deliverer functions as a money collector as well in place of a seller, when handing over an article to a consumer to receive money, the deliverer has to issue a receipt. Since the receipt has such nature that the value of the packed article can be comprehended from the sum of money, the information should be concealed in view of eliminating the risk of theft. Also, article name or the like indicating the content of the packed article is information to be concealed relevant to privacy of the consumer. Particularly, article name or the like is deemed as information that should be concealed even from the deliverer.

In view of this point, when the delivery slip has a structure such that a plurality of forms is laminated and bundled, the article can be handed over to the consumer in a state that confidentiality is ensured by printing the receipt and article name in a part of the delivery slip. However, when a delivery slip of this type is employed, the available label printer is limited.

To eliminate such limitation on the printer, a sheet type delivery slip needs to be employed. With the sheet type delivery slip, however, confidential information to be concealed from others is also seen from the outside.

A patent document 1 discloses a label used as a sheet type delivery slip. The label is a sheet type label including a confidential information form portion formed continuous with an open information form portion. The label is arranged in such a manner that the confidential information form portion is turned back to the rear face side of the open information form portion, and the open information form portion is stuck to the object, whereby the confidential information form portion is concealed from the outside.

[Patent document 1] Japanese Patent Application Laid-Open No. 2001-246882

DISCLOSURE OF THE INVENTION

Problem to be Solved by the Invention

However, a label described in the patent document 1 has such a disadvantage that the label requires a step to be folded back by hand. Also, in the label, an adhesive layer is not exposed all around the peripheral area of the label folded back to the rear face side, but is exposed in a partial area. That is, there is such a disadvantage that an area of the label along a fold line is left in a state unstuck to the object; and accordingly, apart of peripheral portion of the stuck label floats up and waves resulting in an unintended peel-off of the label.

OBJECT OF THE INVENTION

The present invention has been proposed in view of the foregoing disadvantages. It is an object of the present invention to provide a label printer capable of automatically laminating large and small labels, and suitable for printing confidential information on a label with a smaller plane area and sticking the label in a state being concealed between a label with a larger plane area and the object.

Means for Solving Problem

To achieve the above-described object, a label printer according to the present invention includes: a feed-out means that feeds out a raw strip sheet temporarily stuck with a first label and a second label having a smaller plane area than that of the first label on one surface of a release liner; a printing means that performs printing on the first and second labels on the way of feeding out the raw strip sheet; a peeling means that peels off the first and second labels from the release liner; first and second label holding means that hold the first and second labels each peeled off by the peeling means; and a laminating means that laminates the first and second labels in such a manner that an adhesive layer of the second label faces an adhesive layer of the first label.

The present invention employs an arrangement that the second label is laminated on the first label in such a manner that the adhesive layer of the first label is exposed in a closed loop manner in an outer peripheral side of the second label.

Also, an arrangement is employed that the first label holding means is supported by a cylinder device and is arranged to be movable forward and backward with respect to a predetermined object, and when the first label holding means is pressed against the object, the second label is sandwiched between the first label and the object via the adhesive layer exposed in the outer periphery side of the first label.

Further, the first and second label holding means respectively include a first label suction plate and a second label suction plate, and the second suction plate is arranged to be movable forward and backward along a label feed-out direction.

Furthermore, such an arrangement is employed that the first label is formed with a tear-off line within a face thereof for permitting the first label to be partially torn off in a state being laminated with the second label.

On this occasion, a notch portion may be formed at a predetermined portion along the tear-off line, and the notch portion may form a roll-up portion after the second label is stuck in a state being sandwiched between the first label and the object.

Further, each of the label suction faces of the first holding means and second holding means is arranged to substantially correspond to the plane area of each of the first and second labels.

EFFECT OF THE INVENTION

According to the label printer of the present invention, since the second label is formed smaller than the first label in plane area and, after laminating the second label on the first label, the labels are stuck with the second label sandwiched between the first label and the object, the entire peripheral area of the first label can be stuck to the object. Accordingly, partial floating or the like in the outer periphery of the stuck label can be prevented effectively; and thus, the information printed on the second label can be completely concealed.

Also, since the second label suction plate is arranged movably forward and backward along the feed out direction of the label, positional adjustment is possible along the feed-out direction when sticking the second label to the adhesive layer side of the first label.

Further, by forming the tear-off line and the notch portion within a surface of the first label, the second label can be torn off easily along with a part of the first label; and the roll-up portion can be used on the tearing off.

Furthermore, since the label suction faces of the first holding means and the second holding means substantially correspond to the plane area of the first and second labels respectively, the suction position between the labels can be adjusted with great ease; and thus the accuracy of the laminating position between the first and second labels can be satisfactorily ensured.

EXPLANATION OF THE REFERENCE NUMERALS

Figure 1:
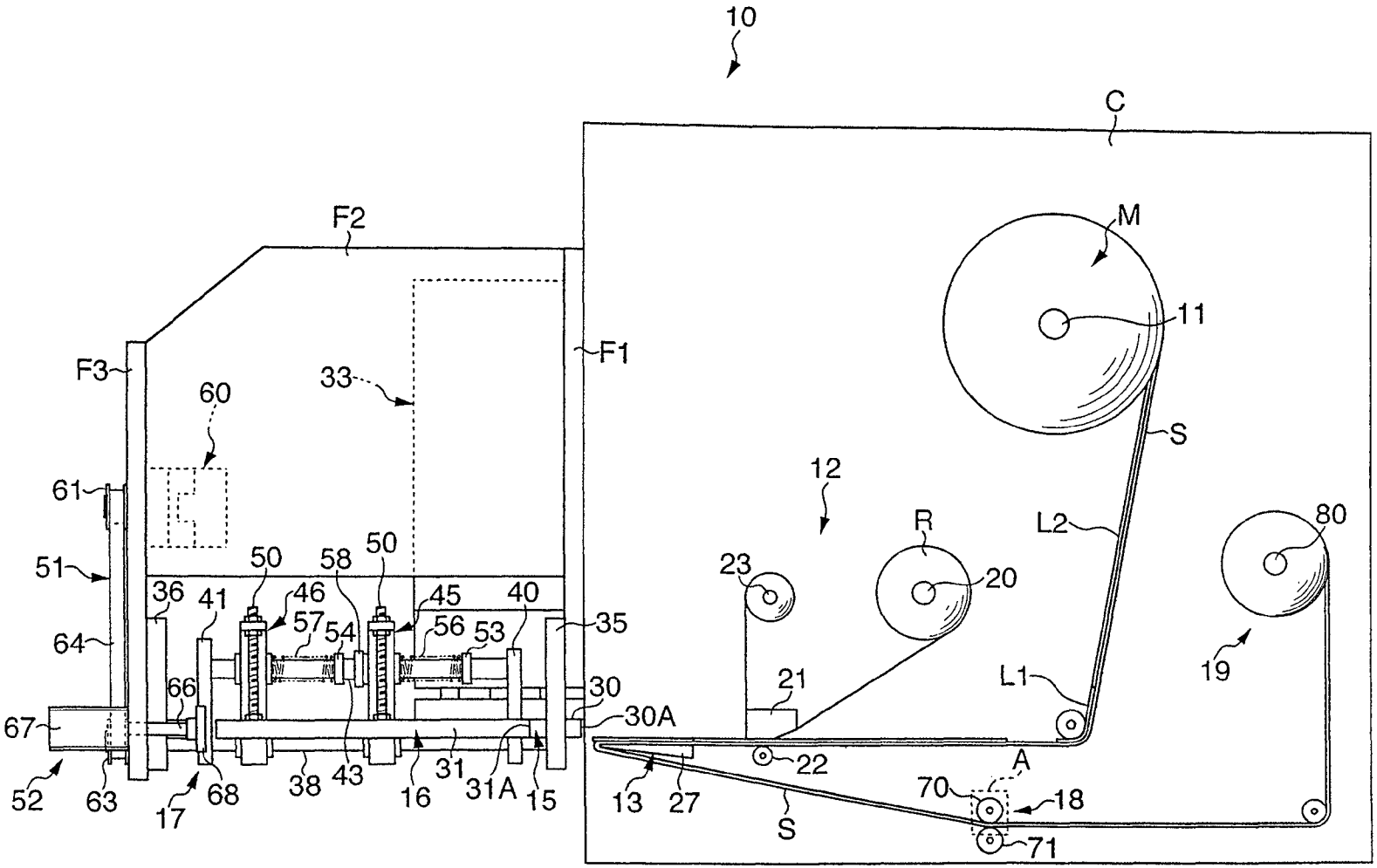
FIG. 1 is a schematic front view of a label printer according to an embodiment of the present invention.

10: label printer
11: support roll (feed-out means)
12: printing means
13: peeling means
15: first label holding means
16: second label holding means
17: laminating means
27: peel plate
30: first label suction plate
31: second label suction plate
33: cylinder device
52: forward/backward movement device
L1: first label
L2: second label
M: raw strip sheet
S: release liner

BEST MODES FOR CARRYING OUT THE INVENTION

Now, referring to the drawings, preferred embodiments of the present invention will be described.

Figure 2:
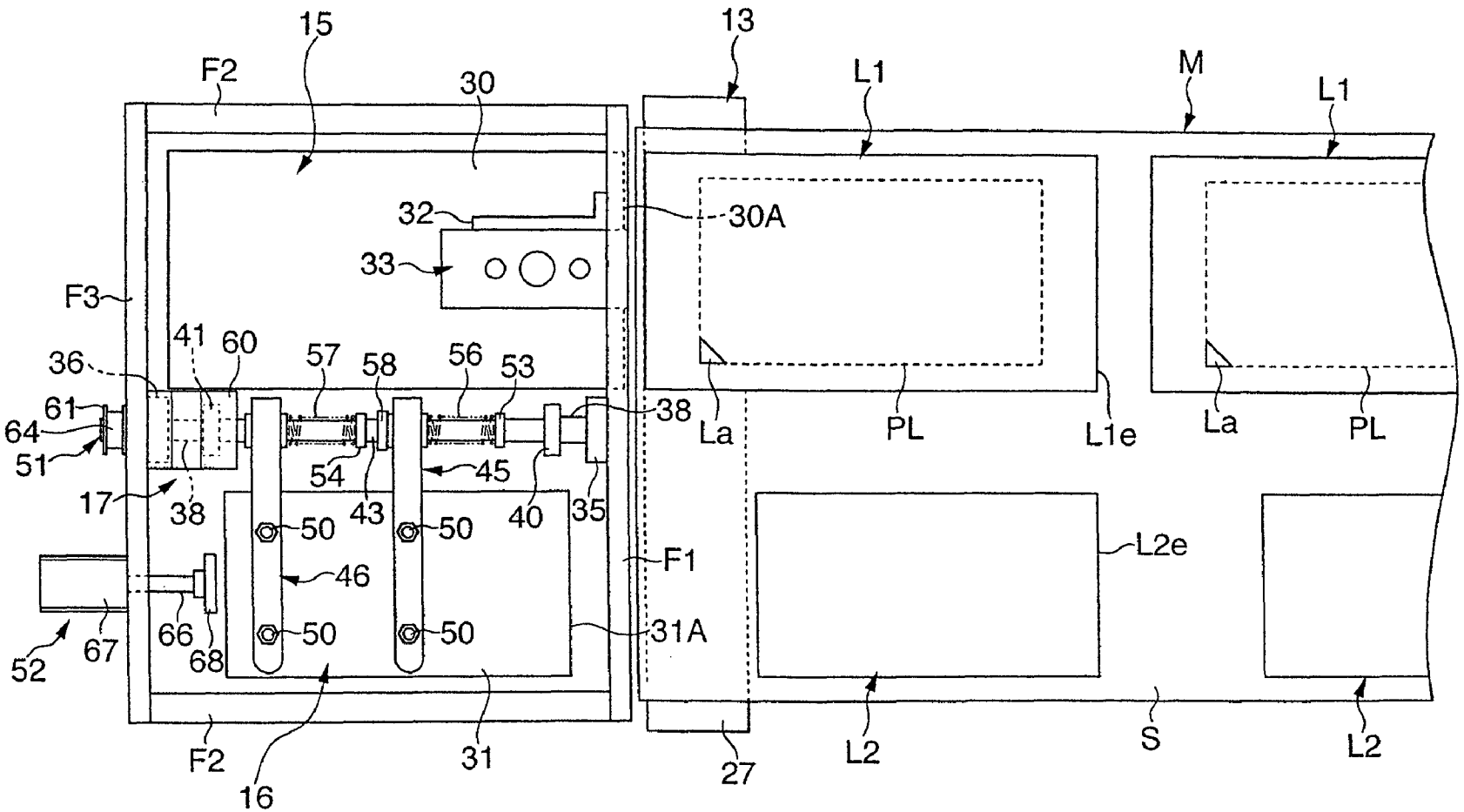
FIG. 2 is a schematic plan view of an essential portion in the label printer.

FIG. 1 shows a schematic front view of a label printer according to an embodiment of the present invention, and FIG. 2 shows a schematic plan view thereof. Referring to these figures, a label printer 10 includes a printer case C; a support roll 11 provided within the printer case C and serving as a feed-out means that supports a raw strip sheet M, which is temporarily stuck with first and second labels L1, L2 on one surface of a strip of release liner S, so as to be capable of feeding out the raw strip sheet M therefrom; a printing means 12 that performs printing on the first and second labels L1, L2 on the way of feeding out the raw strip sheet M; a peeling means 13 that peels off the first and second labels L1, L2 from the release liner S; first and second label holding means 15, 16 that hold the first and second labels L1, L2, respectively, which are peeled off by the peeling means 13; a laminating means 17 that laminates the first and second labels L1, L2 in such a manner that an adhesive layer of the second label L2 faces an adhesive layer of the first label; a feed-out force imparting means 18 that imparts a feed-out force to the raw strip sheet M; and a winding means 19 that winds the release liner S from which the first and second labels L1, L2 have been peeled off. It should be noted that the printer case C is formed with a discharge port (not shown) which discharges the first and second labels L1, L2 through a front area of the peeling means 13 (left-hand side in FIG. 1).

The raw strip sheet M in this embodiment includes the first and second labels L1, L2, which are temporarily stuck on one surface of the release liner S as shown in FIG. 2. The first and second labels L1, L2 are arranged as a set, in which a pair of the first and second labels L1, L2, one each, is aligned along a width direction of the release liner S (vertical direction in FIG. 2), and plural sets thereof are disposed intermittently at predetermined intervals along an extending direction of the release liner S. The second label L2 is formed to have a plane area smaller than that of the first label L1. Specifically, the second label L2 is formed in a substantially rectangular shape, the length (right-left dimension in FIG. 2) and the width (vertical dimension in FIG. 2) of which are smaller than the length and width of the first label L1. Also, the second label L2 and the first label L1 are arranged so that the respective tail end L2*e* and tail end L1*e* are aligned on a substantially same line along the width direction of the release liner S whereby the peeling-start timing of the second label L2 slightly delays relative to the peeling-start timing of the first label L1; and the respective peeling-end timings substantially coincide with each other. The first and second labels L1, L2 are temporarily stuck on the release liner S via an adhesive layer formed on the rear surface side thereof. The raw strip sheet M is formed in such a manner that incisions (half-cut) corresponding to the configurations of the first and second labels L1, L2 are formed at predetermined intervals in a strip of label base material, which has an identical width to that of the release liner S, and the label base material located at the peripheral side of the labels L1, L2 is peeled off as a waste. It is noted that when a die-cut device for forming the half-cut and a waste winding device are provided within the label printer 10, the printing can be also carried out on the first and second labels L1, L2 while forming the first and second labels L1, L2.

As shown in FIG. 2, in each surface of the first labels L1 is formed with a perforated line PL as a tear-off line corresponding to the outer size of the second label L2. The perforated line PL is formed for permitting an inner area excluding an outer area of the first label L1 to be torn off along with the second label L2, after the labels L1, L2 are laminated in such a manner that the adhesive layer of the second label L2 faces the rear surface, i.e., the adhesive layer of the first label L1. In place of the perforated line PL, a continuous incision may be formed. Formed in a corner area of the perforated line PL is a roll-up portion La formed by removing a part of the first label L1. The roll-up portion La facilitates the roll-up operation when tearing the inner area of the first label L1 at the position of the perforated line PL along with the second label L2. In this embodiment, in the case where the object is, for example, a home-delivery article, on the first label L1, non-confidential information such as receiver's address and sender's name of the article is printed; and on the second label L2, confidential information that should be concealed is printed.

The printing means 12 includes a ribbon holding roll 20 that holds an ink ribbon R wound in a roll-like shape; a printing head 21 that prints predetermined printing information with the ink ribbon R, which is fed out from the ribbon holding roll 20 and wound thereon; a platen roll 22 facing the printing head 21 interposing the raw strip sheet M therebetween; a ribbon winding roll 23 for the ink ribbon R; and a driving device (not shown) that drives to rotate the ribbon winding roll 23. In the present embodiment, the printing head 21 is composed of a thermal head that performs the printing on the first and second labels L1, L2 and the printing is performed using the ink ribbon R. However, when the first and second labels L1, L2 are formed of a heat sensitive paper, the ink ribbon R is not necessary. Further, an ink jet printer, a laser printer or the like may be employed in place of the thermal head.

The peeling means 13 is composed of a peel plate 27 disposed at the downstream side in the feed-out direction of the raw strip sheet M with respect to the printing head 21, and is arranged so that the raw strip sheet M is sharply turned over at the front-end position of the peel plate 27 thereby peeling off the first and second labels L1, L2 from the release liner S.

The first and second label holding means 15, 16 include first and second label suction plates 30, 31, each having a suction face at the bottom face side thereof which has a plane area substantially corresponding to each plane area of the first and second labels L1, L2. The first and second label suction plates 30, 31 are disposed in lower portion between a rear frame F1, which is fixed to the front-end face (left end face in FIG. 1) of the printer case C, and a front frame F3 coupled with the rear frame F1 via coupling frames F2, F2. The first label suction plate 30 is disposed so that a rear end 30A thereof extends backward exceeding the lower end of the rear frame F1 (right side in FIG. 1) and is located at a position immediately close to the front end of the peel plate 27. The first label suction plate 30 is supported by a cylinder device 33, which is fixed within the plane of the rear frame F1 via a bracket 32, an disarranged to move forward and backward with respect to the upper face of the object W passing below the cylinder device 33 along a conveyance pass P (refer to FIG. 4).

The second label suction plate 31 is supported between the rear frame F1 and the front frame F3 via the laminating means 17. The laminating means 17 includes a pair of bearing plates 35, 36 each fixed to the lower opposed faces of the rear frame F1 and the front frame F3 respectively; a rotary shaft 38 that extends between the lower portions of the bearing plates 35, 36 and has a length so as to allow the front end side thereof (left end side in FIG. 1) to extend forward penetrating through the bearing plate 36; a pair of rotating shaft fixing plates 40, 41 that are fixed to the rotary shaft 38 and located inner side of the bearing plates 35, 36; a rotating shaft 43 fixed to the rotating shaft fixing plates 40, 41 in an upper portion thereof; a first arm 45 and a second arm 46 that have a substantially L-like shape in side view and are fixed to the rotating shaft 43 and the rotary shaft 38 in a state of crossing over the both; a plurality of bolts 50 that are located between the first and second arms 45, 46 and the second label suction plate 31, and connects the second label suction plate 31 to the first and second arms 45, 46; a rotary-driving device 51 that imparts a rotary force to the rotary shaft 38; and a forward/backward movement device 52 that moves the second label suction plate 31 forward and backward along the label feed-out direction.

The rotating shaft 43 is provided with ring-like spring receiving members 53, 54 fixed to the first and second arms 45, 46 respectively at the right side thereof in FIG. 1. Between the spring receiving members 53, 54 and the first and second arms 45, 46, coil springs 56, 57 are provided, whereby the first and second arms 45, 46 are energized in a forward direction of the rotating shaft 43. On the other hand, the movement of the first arm 45 is regulated by a stopper 58 fixed in a substantially central area of the rotating shaft 43 so that the first arm 45 stops at an initial position; i.e., at a position where the second label L2 sucked by the second label suction plate 31, is stuck to the first label L1 inside the perforated line PL after rotating.

The rotary-driving device 51 includes a rotary actuator 60 fixed to the front frame F3 at the rear face (inner face) side thereof; an upper pulley 61 fixed to an output shaft of the rotary actuator 60; a lower pulley 63 fixed to the front end of the rotary shaft 38; and a timing belt 64 laid around between the upper and lower pulleys 61, 63. The rotary-driving device 51 is arranged so that the rotary shaft 38 is driven to rotate by the rotary actuator 60, and with the rotary shaft 38 as the rotation center, the first and second arms 45, 46 rotate along with the rotating shaft 43 whereby the second label suction plate 31 fixed to the first and second arms 45, 46 is driven to rotate in a state that the second label suction plate 31 is turned to the bottom face side of the first label suction plate 30 with the upper and lower faces thereof upside down.

Figure 3:
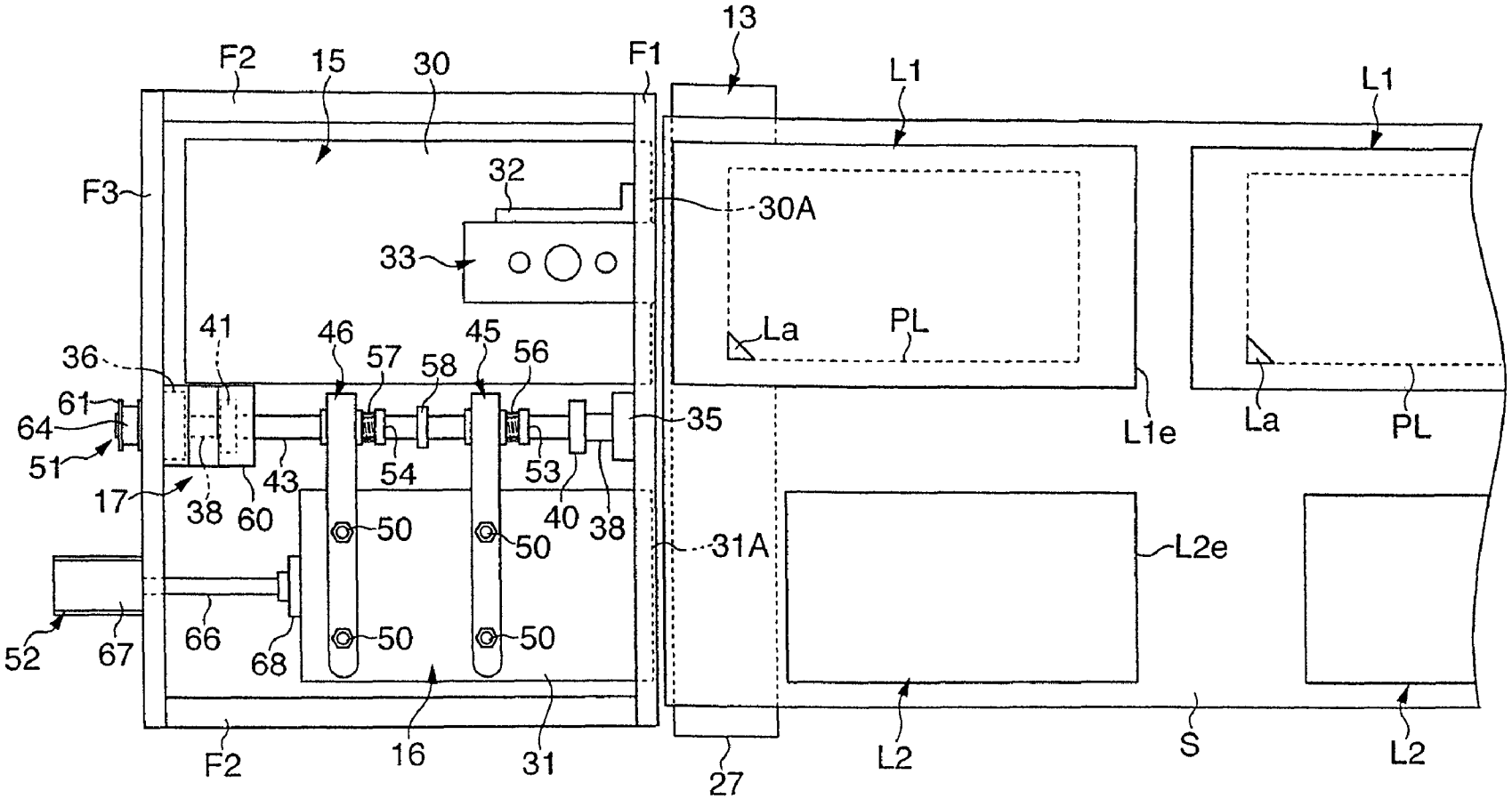
FIG. 3 is a schematic plan view of the essential portion showing a state that a second label suction plate has moved to a peel plate side.

The forward/backward movement device 52 includes an air cylinder 67 that is fixed to the front face of the front frame F3 and is disposed so that a piston rod 66 extends to the inside of the front frame F3 penetrating the front frame F3; and an contact pad 68 that is fixed to the front end of the piston rod 66 and comes into contact with the front end face of the second label suction plate 31. The forward/backward movement device 52 is arranged so as, when the piston rod 66 protrudes, to move the second label suction plate 31 backward toward the peel plate 27 side against the energizing force of the coil springs 56 and 57 as shown in FIG. 3, whereby the rear end 31A of the second label suction plate 31 is positioned on a substantially same line as the rear end 30A of the first label suction plate 30. On the other hand, the second label suction plate 31 is arranged so as, when the piston rod 66 is positioned at a retracted position, to return to its initial position by the energizing force of the coil springs 56, 57.

The feed-out force imparting means 18 includes a drive roll 70; a pinch roll 71 that nips the release liner S between the same and the drive roll 70; and a motor A that drives to rotate the drive roll 70.

The winding means 19 includes a winding roll 80 that holds the lead end of the release liner S and winds the release liner S. In the winding roll 80, a rotary shaft (not shown) protrudes at the rear face of the printer case C and the rotary shaft is coupled with the output shaft of the motor A constituting the feed-out imparting means 18 so as to be driven via a power transmitting means (not shown) such as pulleys, a belt or the like whereby the release liner S can be wound.

Next, referring to also FIGS. 4 to 8, overall operation of the embodiment is described. For the convenience of description, it is assumed herein that the object W be a home-delivery article, and the first and second labels L1, L2 be printed with relevant information including delivery destination of the article.

A predetermined piece of printing information is inputted in advance through an input device and a control device (not shown). When the motor A as the feed-out imparting means 18 is driven, feeding operation of the raw strip sheet M and winding operation of the release liner S start. At this time, owing to a press force of the contact pad 68 driven by the air cylinder 67 constituting the forward/backward movement device 52, the second label suction plate 31 positioned at the initial position moves toward the peel plate 27 side along with the first and second arms 45, 46 against the pressing force of the coil springs 56, 57 (refer to FIG. 3). The movement amount is adapted to a length in which the rear end 31A of the second label suction plate 31 is substantially aligned with the rear end 30A of the first label suction plate 30. This arrangement ensures a state that each of the first and second label suction plates 30, 31 sucks and holds the first and second labels L1, L2 with the whole area of the respective suction faces thereof.

The first and second labels L1, L2 are printed with the previously inputted information while passing through the printing head 21. The first label L1 is printed with non-confidential information such as receiver's address and name and sender's address and name. On the other hand, on the second label L2, confidential information such as amount of money to be received and article name as well as the date is printed to perform the function of a receipt. The name of the sender may be included in the confidential information depending on the content of the article.

Figure 4:
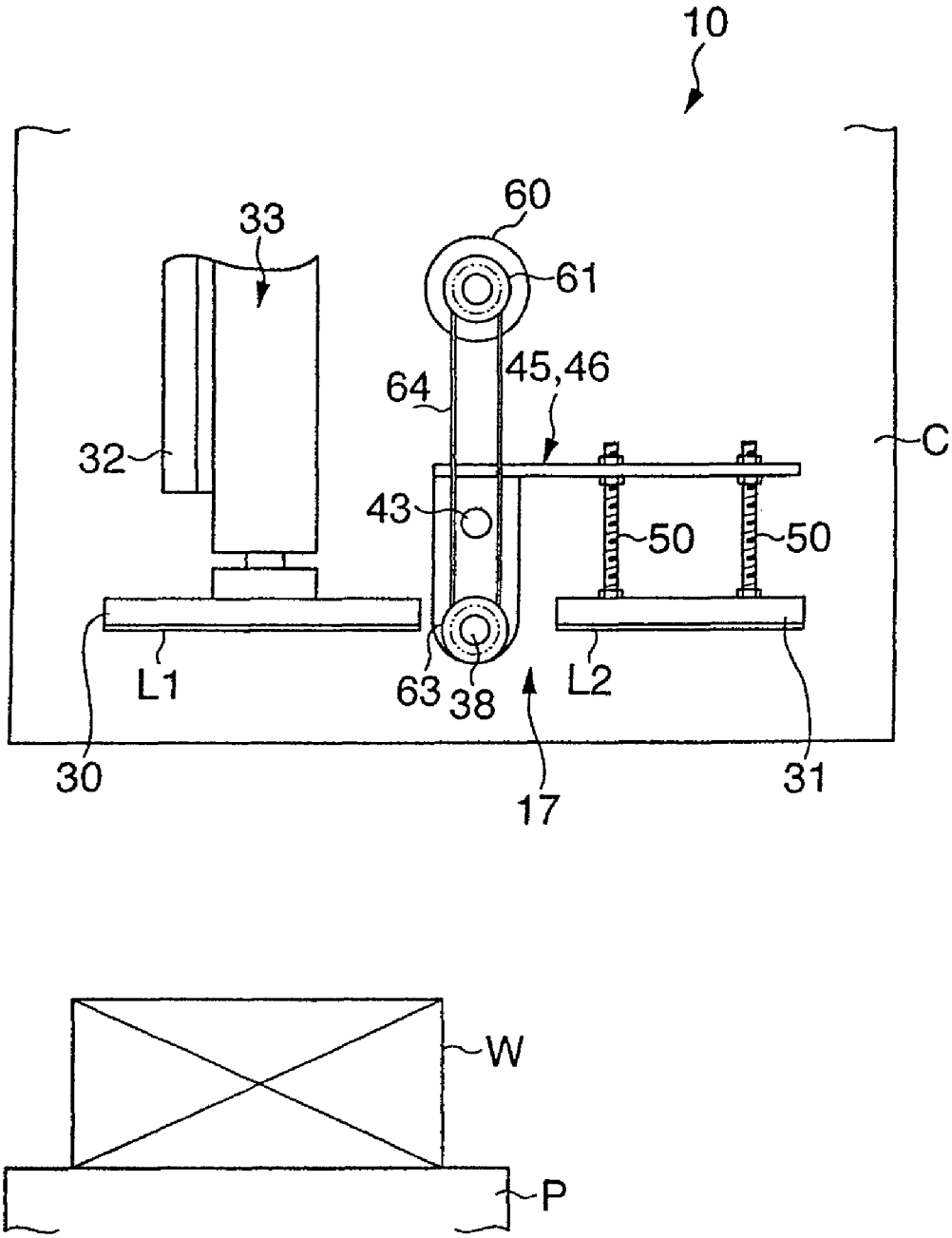
FIG. 4 is a schematic side view of the label printer.

The printed first and second labels L1, L2 are peeled off at the front-end of the peel plate 27, and the first label L1 is sucked and held by the first label suction plate 30; and the second label L2 is sucked and held by the second label suction plate 31 (refer to FIG. 4).

As described above, when the first and second labels L1, L2 are sucked by the respective label suction plates 30, 31, the piston rod 66 of the air cylinder 67 is retracted, and accompanying this, the contact pad 68 moves toward the air cylinder 67. Consequently, the first and second arms 45, 46 are moved by the energizing force of the coil springs 56, 57 along the axial lines of the rotary shaft 38 and the rotating shaft 43, and the second label suction plate 31 held by the shafts is returned to the initial position (refer to FIG. 2).

Figure 5:
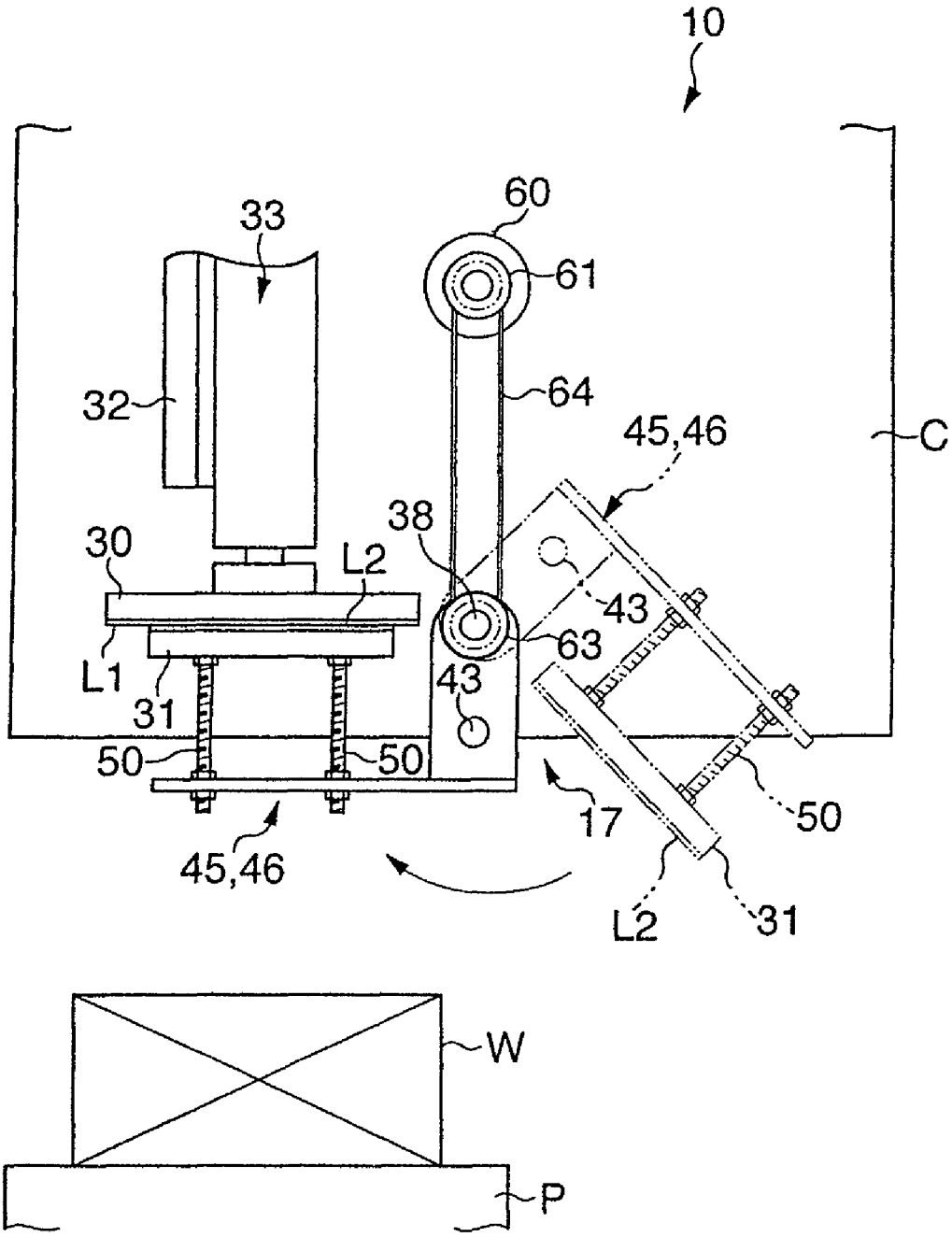
FIG. 5 is a schematic side view showing a state that the second label suction plate has rotated to a bottom face side of the first label suction plate.
Figure 6:
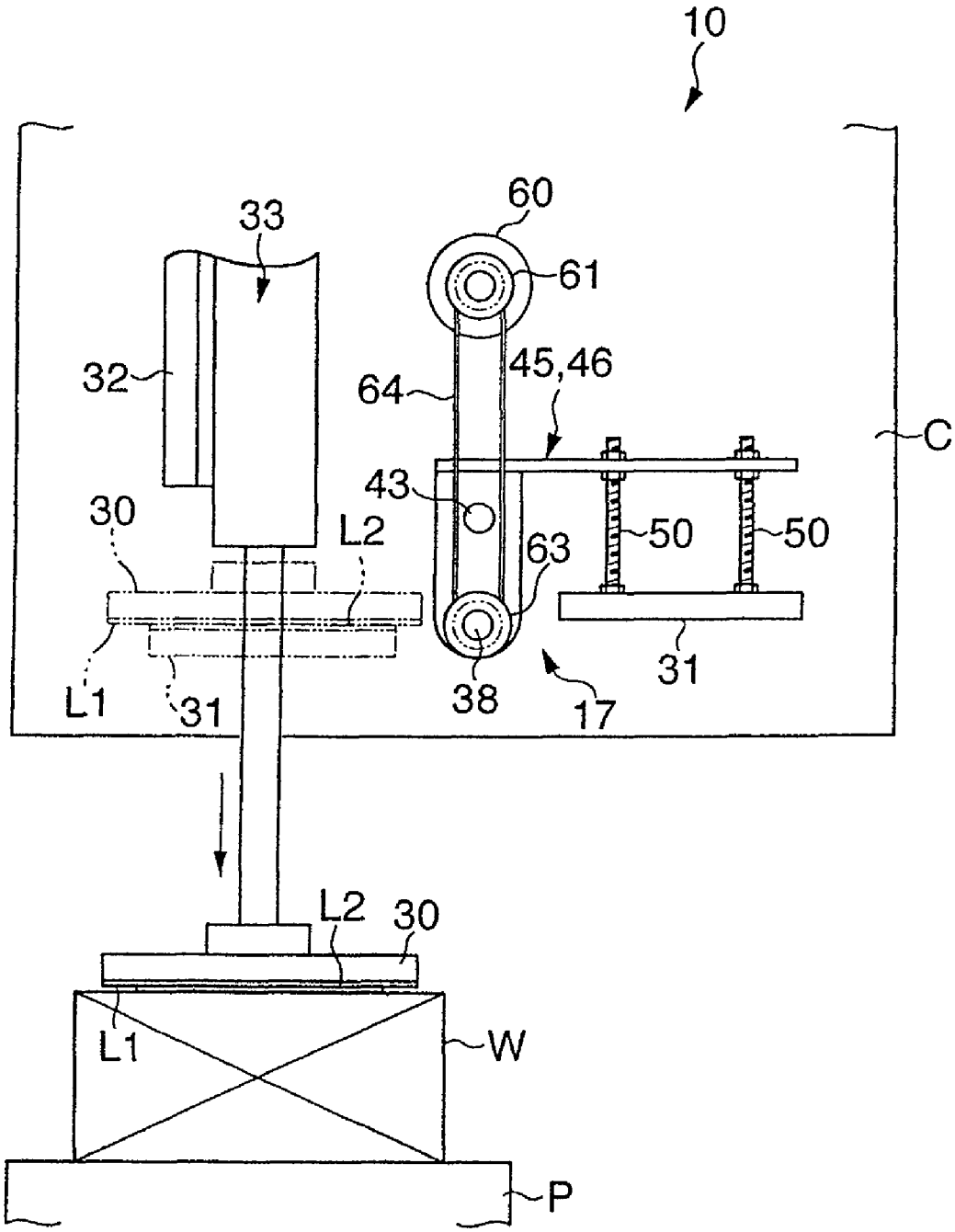
FIG. 6 is a schematic side view showing a state that first and second labels are stuck onto an object in a laminated state.

Then, as shown in FIG. 5, the rotary actuator 60 of the rotary-driving device 51 rotates and the rotary shaft 38 is driven to rotate via pulleys 61, 63 and the timing belt 64; whereby the rotating shaft 43, the first and second arms 45, 46 and the second label suction plate 31 are rotated integrally in the clockwise direction in FIG. 5 via the rotating-shaft fixing plates 40, 41 fixed to the rotary shaft 38. The rotation angle is substantially 180°. Owing to this, the second suction plate 31 is rotated to a position substantially parallel to the first suction plate 30; and the first and second labels L1, L2 are laminated, with the adhesive layer of the second label L2 facing the adhesive layer of the first label L1. Thus, the adhesive layer of the first label L1 is exposed in a closed loop manner in the peripheral area of the second label L2.

Figure 7:
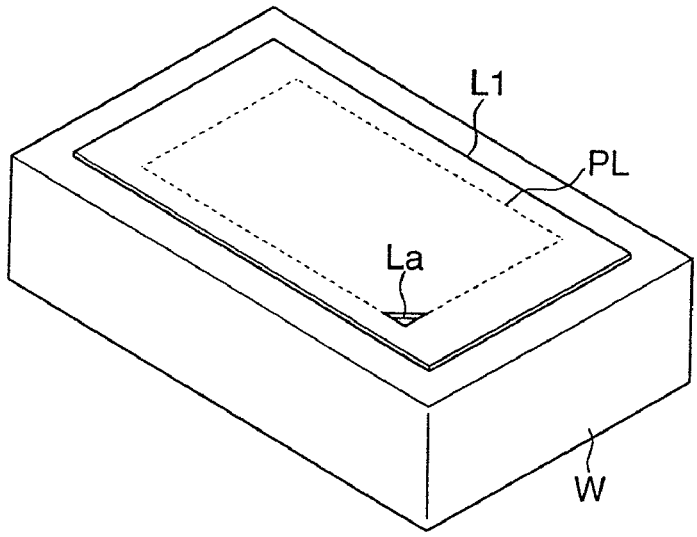
FIG. 7 is a schematic perspective view showing a state that the labels are stuck to the object.
Figure 8:
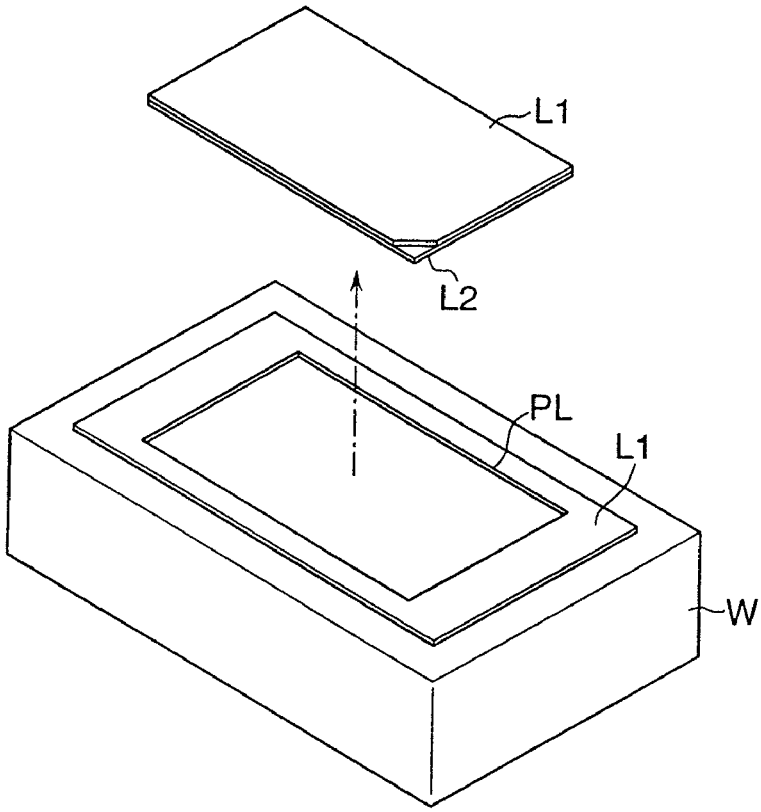
FIG. 8 is a schematic perspective view showing a state that an inner portion of the labels stuck on the object is torn off along a perforated line.

When the lamination is completed, the second suction plate 31 returns to the initial position (refer to FIG. 6), and the first label suction plate 30 is moved downward via the cylinder device 33 and pressed against the surface of the object W, which stands by below the first label suction plate 30, whereby the adhesive layer of the first label L1 is stuck onto the surface of the object W in a state that the second label L2 is sandwiched between the first label L1 and the object W (refer to FIG. 7). In this state, since the adhesive layer of the first label L1 is stuck to the entire area around the periphery of the second label L2, there is no partially floated area in the outer periphery of the label after the label is stuck.

In the first and second labels L1, L2 stuck to the object W, the inner part enclosed by the perforated line PL can be torn off. At this time, by nipping the roll-up portion La with tips of fingers and pulling up the same, the entire area within the perforated line PL can be rolled up and torn off (refer to FIG. 7, FIG. 8). Thus, the information printed on the second label L2 can be confirmed, and the second label L2 can be stored, if necessary.

Consequently, according to the embodiment, such a label printer can be provided that has a function to perform printing using a sheet type label and stick the same to an object in a state that confidential information is concealed. Also, the stuck label does not have any area without sticking in the periphery side thereof; and thus, unintended roll-up or peel-off can be prevented thereafter.

The best arrangement, method and the like for carrying out the present invention have been disclosed so far as described above. However, the present invention is not limited to the above description.

That is, the present invention has been illustrated and described mainly about a specific embodiment. However, it is possible for those skilled in the art to add various modifications, if necessary, to the above-described embodiment with regards to the detailed arrangement such as the shape, location, layout and the like without departing from the technical spirit and the range of the object of the present invention.

For example, the perforated line PL of the first label L1 applied to the present invention is not limited to the examples of illustrated arrangements, but a perforated line enabled to be broken into smaller parts may be adopted. Here, when the second label L2 is arranged to form the similar perforated line or tear-off line, peeling-off units from the object W can be pluralized.

The second label also may be formed with a notch in an area where the roll-up portion La is located. This arrangement will facilitate the roll-up operation when the inner area of the first label L1 is torn off along with the second label L2 at the perforated line PL.

The plane configuration of the label L is not limited to a square shape, but items having a various plane configuration like a polygonal, circular, elliptical shape may be regarded as the object. In brief, as far as the label is printed and stuck to the object in a state that the confidential information is concealed, and moreover the sticking can be carried out so that the adhesive layer of the first label L1 is exposed around the entire outer periphery of the second label L2, various design change can be introduced.

The invention claimed is:

1. A label printer, comprising:

a feed-out means that feeds out a raw strip sheet temporarily stuck with a first label and a second label having a smaller plane area than that of the first label on one surface of a release liner;

a printing means that performs printing on said first and second labels on the way of feeding out said raw strip sheet;

a peeling means that peels off the first and second labels from said release liner;

first and second label holding means that hold the first and second labels each peeled off by the peeling means; and a laminating means that laminates said first and second labels in such a manner that an adhesive layer of the second label faces an adhesive layer of the first label.

2. The label printer according to claim 1, wherein said second label is laminated on said first label in such a manner that the adhesive layer of the first label is exposed in a closed loop manner in an outer peripheral side of the second label.

3. The label printer according to claim 1, wherein said first and second label holding means include a first label suction plate and a second label suction plate, and the second suction plate is arranged to be movable forward and backward along a label feed-out direction.

4. The label printer according to claim 1, wherein said first label is formed with a tear-off line within a face thereof for permitting the first label to be partially torn off in a state being laminated with the second label.

5. The label printer according to claim 4, wherein a notch portion is formed at a predetermined portion along said tear-off line, and the notch portion forms a roll-up portion after said second label is stuck in a state being sandwiched between said first label and object.

* * * * *